United States Patent [19]

Jessup et al.

[11] Patent Number: 4,781,728

[45] Date of Patent: Nov. 1, 1988

[54] OCTANE ENHANCERS FOR FUEL COMPOSITIONS

[75] Inventors: Peter J. Jessup, Santa Ana; Stephen G. Brass, Fullerton; Michael C. Croudace, Huntington Beach, all of Calif.

[73] Assignee: Union Oil Company of California, Los Angeles, Calif.

[21] Appl. No.: 900,726

[22] Filed: Aug. 27, 1986

Related U.S. Application Data

[63] Continuation-in-part of Ser. No. 728,245, Apr. 29, 1985, Pat. No. 4,647,292.

[51] Int. Cl.[4] ..... C10L 1/02; C10L 1/18; C10L 1/22; C10L 1/24

[52] U.S. Cl. ..... 44/56; 44/70; 44/71; 44/72; 44/76

[58] Field of Search ..... 44/70, 71, 72, 76, 69, 44/56; 556/413–415, 422, 427, 436

[56] References Cited

U.S. PATENT DOCUMENTS

| | | | |
|---|---|---|---|
| 2,212,992 | 8/1940 | Sowa | 44/72 |
| 2,529,496 | 11/1950 | Hughes | 44/76 |
| 2,765,221 | 10/1956 | Lusebrink et al. | 44/76 |
| 2,992,083 | 7/1961 | Bluestein et al. | 44/72 |
| 3,063,818 | 11/1962 | Sutton et al. | 44/76 |
| 3,308,146 | 3/1967 | Merker | 44/76 |
| 3,377,149 | 4/1968 | Eckert et al. | 44/69 |
| 3,419,367 | 12/1968 | Eckert et al. | 44/66 |
| 3,442,631 | 11/1969 | Gluckstein | 44/76 |
| 3,647,749 | 3/1972 | Zaweski et al. | 44/76 |
| 4,272,254 | 6/1981 | Minezaki | 44/76 |
| 4,385,904 | 5/1983 | Sawicki et al. | 44/56 |
| 4,398,921 | 8/1983 | Rifkin et al. | 44/56 |
| 4,647,292 | 3/1987 | Jessup et al. | 44/66 |

FOREIGN PATENT DOCUMENTS

| | | |
|---|---|---|
| 82-688 | 6/1983 | European Pat. Off. . |
| 1444431 | 7/1986 | United Kingdom . |

OTHER PUBLICATIONS

"Knocking Characteristics of Pure Hydrocarbons" developed under American Petroleum Institute Research Project 45, published by the *American Society for Testing Materials, ASTM Special Technical Publication No.* 225, May 1958, pp. iii, 2, 7 to 15, 20, 21, and 68.

*Primary Examiner*—William R. Dixon, Jr.
*Assistant Examiner*—Margaret B. Medley
*Attorney, Agent, or Firm*—Gregory F. Wirzbicki

[57] ABSTRACT

The octane value of fuels such as gasoline is increased by adding thereto an organic compound containing a tert-butyl group or a radical containing a trimethyl silyl group bonded to a carbon or nitrogen atom, which, in turn, is bonded to yet another atom by double or triple bonds.

70 Claims, No Drawings

OCTANE ENHANCERS FOR FUEL COMPOSITIONS

CROSS-REFERENCE TO RELATED APPLICATIONS

This application is a continuation-in-part of U.S. patent application Ser. No. 728,245 filed Apr. 29, 1985, now U.S. Pat. No. 4,647,292.

BACKGROUND OF THE INVENTION

The present invention relates to an anti-block additive for fuel compositions, primarily gasoline compositions.

The petroleum industry has long recognized a need for greater fuel economy and efficiency in the operation of gasoline powered spark ignition engines. In many instances, high compression ratios are desired in order to provide for superior engine performance under various driving conditions. In order to provide high performance in high compression engines without the risk of knock damage, fuels which will be used in such engines require a high octane number and good anti-knock characteristics.

While octane ratings of fuels can be improved by blending appropriate refining streams, the necessary additional refining and blending operations needed to obtain a fuel having the desired high octane rating are costly. In lieu of these various defining and blending processes the petroleum industry sometimes blends anti-knock additives into fuels to increase the octane number of the fuel. For many refineries the use of anti-knock compounds is essential due to the lack of the refining and blending facilities to produce the high octane fuels.

Numerous compounds have been suggested as anti-knock additives for fuel compositions. The most successful of these anti-knock compounds additives are organo-lead compounds. However, the future use of organo-lead compounds as anti-knock additives is severely limited by recent legislation and is completely prohibited in the future.

As a replacement for lead-containing additives, numerous non-lead, anti-knock compounds have been suggested as octane improvers. Among these are rare earth beta-keto-enolate compounds, the lithium and sodium salts of organo-amino-cresols, various other organo metallic compounds, in particular organo-iron and organo-manganese compounds, such as iron pentacarbonyl and methylcyclopentadienyl manganese tricarbonyl. In addition, it is known to improve the anti-knock and octane properties of gasoline by blending alcohol therewith.

These anti-knock additives have their own associated problems when blended into fuels for use in internal combustion engines. The numerous organo-iron compounds increase the potential of wear in internal combustion engines and the organo-manganese compounds, in addition to causing wear problems, may affect the catalytic converters used on most cars today to reduce air pollution for exhaust emissions. Fuel compositions of gasoline and alcohol have many problems, including separation if water is admixed with the composition. As a result, there is a need for additives for increasing the octane value of gasoline without causing any detrimental effects, particularly the detrimental effects of lead, iron and other metal octane improvers or the miscibility problems of alcohol.

SUMMARY OF THE INVENTION

The present invention is founded on the unexpected discovery that organic compounds containing a tert-butyl, a trimethyl silyl group, or an organic radical containing a trimethyl silyl group bonded to a carbon or nitrogen atom which in turn is bonded by unsaturated double or triple bonds to another atom, provide octane enhancement to gasoline. Alternatively expressed, it has been found that compounds containing a carbon or nitrogen atom bonded to another atom by at least one pi bond are useful for improving the octane value of gasoline, provided that there is also bonded to said carbon or nitrogen atom at least one of the following: (1) a substituted or unsubstituted tertiary butyl group; (2) a substituted or unsubstituted trimethyl silyl group; and (3) an organic radical containing a substituted or unsubstituted silyl trimethyl group.

Accordingly, the invention provides a fuel composition comprising a base fuel, such as gasoline, and an octane improver comprising one or more of the above described compounds, except where the unsaturated bonding is (1) between two carbon atoms in an unsubstituted phenyl ring of formula $-C_6H_5$ or (2) between two carbon atoms where one of the carbon atoms is bonded only to species selected from the group consisting of hydrogen and methyl.

In addition, the invention provides a method for operating an internal combustion engine, such as an automotive engine, wherein the fuel employed to power the engine is a fuel composition of the invention.

DETAILED DESCRIPTION OF THE INVENTION

The invention is directed to enhancing the octane of gasoline by the addition of certain additives. As stated earlier, there are many known compounds which enhance the octane value of gasoline, the most well known undoubtedly being tetraethyllead. However, it is also known that t-butyl benzene and 3,3-dimethyl-1-butene can provide octane enhancement to gasoline, but heretofore it was unknown that compounds having either a tert-butyl group or an organic radical containing a trimethyl silyl group bonded to an unsaturated carbon or nitrogen atom would, as a class, have the common property of enhancing the octane value of gasoline. In the present invention, however, it has been found that such compounds do in fact share this common property.

The class of most useful compounds discovered in the present invention to provide octane enhancement to gasoline are represented by the following generic formulae:

$$R1-\overset{\overset{Y}{\|}}{X}-R2 \quad \text{or} \quad R1-X\equiv Y \quad \text{or} \quad R1-N=Z \quad \text{or} \quad R1-A$$

(I) (II) (III) (IV)

wherein X=Y is C=O, C=N—R3, C=C=W,

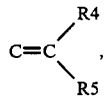

or C=S; X≡Y is C≡N or C≡C—R6; N=Z is N=O, N=C=W, or

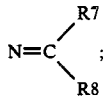

W is oxygen or sulfur; A is an aryl-containing group with $R^1$ bonded to the carbon atom of an aromatic ring; $R^1$ is either a substituted or unsubstituted tert-butyl group, a substituted or unsubstituted trimethyl silyl group, or an organic radical containing a substituted or unsubstituted trimethyl silyl group; and R2, R3, R4, R5, R6, R7, and R8 are the same or different organic or inorganic species. (As used herein, the term "organic" refers to any chemical species containing one or more carbon atoms. As a corollary, the term "inorganic" refers to any chemical species not containing at least one carbon atom, e.g., —H, —Cl, —Br, etc.)

The compounds most suitable for use in the invention are gasoline-soluble and conform to the above formulae (I) through (IV) except that X=Y is other than $C{=}CR^4R^5$ where $R_4$ is hydrogen or a methyl group and A is other than a phenyl ring, i.e., $-C_6H_5$. The preferred compounds are those of formulae (I), (II), and (III), with preferred compounds of formula (III) having N=Z equal to N=C=O. The most preferred compounds, however, conform to formula (I) or (II) wherein X=Y is C=O and X≡Y is C≡N. Preferably, R1 is either an unsubstituted tert-butyl group or trimethylsilylacetate group, with the unsubstituted tert-butyl group presently being most preferred. In the preferred embodiment, R2 is an organic radical of about 1 to 20 carbon atoms, more preferably 1 to 10 carbon atoms, with the following groups presently being preferred: substituted or unsubstituted alkyl, carbyloxy, alkoxy, hydroxy, amino, acetyl, and acetyl-containing species of formula:

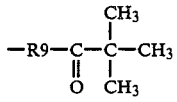

where R9 is an organic radical, usually an alkyl group of 1 to 5 carbon atoms, and most preferably a methylene group. Also, while R3 and R5 to R8 may be any inorganic or organic species, it is preferred that R3, R5, R6, R7, and R8 either be alkyl groups of 1 to 10 carbon atoms or hydrogen, with hydrogen being more preferred, R4, as stated above, may be any inorganic or organic constituent with the exception of hydrogen or methyl, with alkyl groups of 2 to 10 carbon atoms being preferred, and ethyl being most preferred.

A trimethyl silyl group is of chemical formula:

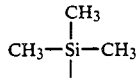

and an organic radical containing a trimethyl silyl group is of formula:

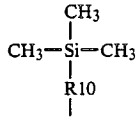

wherein R10 is an organic radical, preferably a straight or branched chain alkyl group of 1 to 15 carbon atoms, more preferably an alkyl group of between 1 and 3 carbon atoms, and most preferably a methylene or dimethylene group, and most highly preferred of all, a methylene group. It will be understood, of course, that the trimethyl silyl group may be substituted, any of the hydrogens in the $-CH_3$ groups being readily available for substitution by organic or inorganic species. However, in the preferred embodiment, the trimethyl silyl group is unsubstituted. Moreover, when a trimethyl silyl group or an organic radical containing a trimethyl silyl group is selected from R1, the preferred compounds conform to formula (I), with X=Y being a C=O group and R2 being an alkyl group or an alkoxy group of 1 to 10 carbon atoms. At present, the most preferred compound for use when R1 is or contains a trimethyl silyl group is t-butyl trimethyl silyl acetate.

Among the specific compounds which prove useful in the invention as octane improvers are pivalonitrile, methyl trimethyl acetate, pinacolone, 2,2,6,6-tetramethyl hexa-3,5-dione, pivalic anhydride, pivalic acid, t-butyl isocyanate, and t-butyl trimethyl silyl acetate. The foregoing compounds have all been found to enhance the octane value of gasoline, some to an extent greater than that presently provided by commercial additives, such as tert-butyl methyl ether. In addition, these compounds are fully soluble in gasoline at a concentration of 5 volume percent, and it is noted that preferred compounds for use in the invention are those which are soluble in gasoline at this level. Further still, no detrimental effects have been found to result from the use of these compounds as octane improvers in unleaded gasoline. (However, silyl-containing compounds may leave an inorganic residue, and if this is not acceptable in certain applications, then a compound containing no ash-forming inorganic constituents is recommended.)

Anti-knock characteristics of an additive are typically evidenced by an increase in the motor and research octane numbers of the base fuel when the additive is admixed therewith. The motor (MON) and research (RON) octane numbers of fuel compositions are typically measured by the method described in ASTM D 2700 and ASTM D 2699, respectively.

The fuel composition may be comprised of any amount of the additive compound of this invention which enhances the anti-knock characteristics of the fuel. In the usual instance, the compositions of the invention are prepared simply by dissolving the desired additive in the fuel in a concentration sufficient to increase the octane value of the fuel. Normally the anti-knock additive comprises a minor amount (i.e., less than 50 percent by volume) of the fuel composition. Usually, the additive is gasoline-soluble (herein defined as soluble at 25° C. to the extent of at least 0.5 grams per 100 ml of gasoline), and, as stated before, is preferably soluble to the extent of at least 5 volume percent. Preferably the fuel composition comprises from about 1 volume percent to about 15 volume percent of the additive compound of this invention, more preferably from about 3 to about 10 volume percent, and most preferably from about 5 to about 10 volume percent of the additive compound.

Base fuels to which the additive of this invention may be included to improve the anti-knock properties include all of the volatile liquid fuels suitable for spark-ignition, internal combustion engines, particularly automotive engines. Suitable liquid hydrocarbon fuels of the gasoline boiling range as described in ASTM D-439 are mixtures of hydrocarbons boiling in the range from about 25° C. (77° F.) to about 225° C. (437° F.), and often comprise mixtures of saturated hydrocarbons, olefinic hydrocarbons and aromatic hydrocarbons. Preferred are gasoline blends consisting of or consisting essentially of a saturated hydrocarbon content ranging from about 40 to about 80 percent by volume, an olefinic hydrocarbon content from about 0 to about 30 percent by volume and an aromatic hydrocarbon content rnaging from about 10 to about 60 percent by volume. The base fuel can be derived from straight run gasoline, alkylate gasoline, polymer gasoline, natural gasoline, dimer and trimerized olefins, synthetically-produced hydrocarbon mixtures, thermally or catalytically reformed hydrocarbons, isomerized and/or hydrotreated stocks, or catalytically cracked or thermally cracked stocks, and mixtures of these. The ultimate source of the base fuel is not critical, i.e., the fuel may be derived from petroleum or hydrocarbons derived from coal, oil shale, natural gas, etc. The hydrocarbon composition and octane level of the base fuel are not critical. In general, any conventional motor fuel base may be employed in the practice of this invention.

The base fuel may contain other additives normally employed in fuels, e.g., anti-icing agents, detergents, demulsifiers, corrosion inhibitors, dyes, deposit modifiers, anti-knock improvers, multi-purpose additives and the like. However, since this invention relates to anti-knock compounds useful for admixture into base fuels, the base fuel used will preferably be essentially free of other anti-knock compounds, particularly the organo-metallic compounds, e.g., organo-lead and organo-manganese compounds, and other anti-knock compounds used in base fuels, specifically, alcohols such as methanol. Thus, the preferred composition of this invention comprises a major portion of a base fuel and an anti-knock enhancing amount of the compound of this invention, with the composition being essentially free of compounds such as organo-lead and organo-manganese compounds and completely free of alcohol. By "essentially free of" it is meant that the composition will comprise less than 0.5 grams each of organo-lead and organo-manganese compounds, per gallon of fuel.

The following examples serve to further illustrate the invention and are not intended to be construed as limiting thereof.

EXAMPLES 1-7

The following Examples 1-7 illustrate the superior performance of pivalic anhydride (containing a tert-butyl group) over six other anhydrides. Various additives were blended into a base fuel at the levels indicated in Table 1. The base fuel was a gasoline containing 33.5 volume percent aromatics, 7.5 volume percent olefins and 59 volume percent saturates having an A.P.I. gravity of 58.4, vapor pressure of 8.6, a sulfur content of 296 ppm, and less than about 0.05 grams of lead/gallon of fuel. The gasoline base fuel had a research octane number of 94.4 and a motor octane number of 84.1. Also indicated in Table 1 are the organic radicals of each anti-knock anhydride tested, said anhydrides being of formula R—CO—O—CO—R', where R and R' in each anhydride are the same.

TABLE 1

| Ex. No. | Anhydride | R&R' | Change in RON 1 vol % | Change in RON 5 vol % | Change in MON 1 vol % | Change in MON 5 vol% |
|---|---|---|---|---|---|---|
| 1 | Pivalic | t-butyl | 0.4 | 1.4 | 0.2 | 0.7 |
| 2 | Propionic | ethyl | 0 | 0.7 | −0.5 | 0.2 |
| 3 | Benzoic | phenyl | −0.4 | 0.2 | 0 | 0.5 |
| 4 | Acetic | methyl | −0.2 | 0.9 | 0 | 0.8 |
| 5 | Valeric | n-butyl | −0.1 | 0.1 | 0 | 0.1 |
| 6 | Butyric | n-propyl | 0 | 0.5 | 0 | 0.5 |
| 7 | Iso-Valeric | i-butyl | 0 | — | 0 | — |

As shown by the data in Table 1, pivalic anhydride outperformed all other anhydrides for increasing octane. The closest competitor was acetic anhydride, which, at the 5% level, showed a comparable MON increase but a match smaller RON increase than pivalic anhydride. In addition, when the average increase is evaluated, that is $(\Delta RON+\Delta MON)/2$, as is usually considered important in fuel performance, it will be seen that pivalic anhydride is clearly superior to acetic anhydride at the 5 vol. % level. The average increase was 1.0 for pivalic anhydride and only 0.8 for acetic anhydride.

EXAMPLES 8 to 15

Because the data in Examples 1 to 7 showed that the tert-butyl group adjacent the C=O group of anhydrides proved the best, with a methyl group being the closest competitor, a series of experiments was performed comparing several components containing a tert-butyl group adjacent a pi system against a methyl group adjacent a pi system for octane improvement. The test method was the same as described for Examples 1 to 7, and the data obtained are summarized in the following Table 2:

TABLE 2

| Example No. | Compound Name | Chemical Structure | Change in RON 1 Vol. % | Change in RON 5 Vol. % | Change in MON 1 Vol. % | Change in MON 5 Vol. % |
|---|---|---|---|---|---|---|
| 8 | Acetonitrile | $CH_3—C\equiv N$ | 0 | −1 | 0 | — |
| 9 | Pivalonitrile | $(CH_3)_3C—C\equiv N$ | 0.3 | 1.4 | 0.3 | — |

TABLE 2-continued

| Example No. | Compound Name | Chemical Structure | Change in RON 1 Vol. % | Change in RON 5 Vol. % | Change in MON 1 Vol. % | Change in MON 5 Vol. % |
|---|---|---|---|---|---|---|
| 10 | Methyl Acetate | $CH_3-\underset{\underset{O}{\|}}{C}-O-CH_3$ | — | 0.4 | — | 0.4 |
| 11 | Methyl Trimethyl Acetate | $(CH_3)_3C-\underset{\underset{O}{\|}}{C}-O-CH_3$ | — | 0.5 | — | 0.6 |
| 12 | Acetone | $CH_3-\underset{\underset{O}{\|}}{C}-CH_3$ | — | 0.7[1] | — | 0.9[1] |
| 13 | Pinacolone | $(CH_3)_3C-\underset{\underset{O}{\|}}{C}-CH_3$ | 0.2 | 1.0 | 0.1 | 0.9 |
| 14 | 2,4-pentanedione | $CH_3-\underset{\underset{O}{\|}}{C}-CH_2-\underset{\underset{O}{\|}}{C}-CH_3$ | — | 0.8 | — | 0.4 |
| 15 | 2,2,6,6-Tetramethyl Hexa-3,5-dione | $(CH_3)_3C-\underset{\underset{O}{\|}}{C}-CH_2-\underset{\underset{O}{\|}}{C}-C(CH_3)_3$ | −0.1 | 0.9 | 0 | 0.5 |

[1]These data from literature sources.

EXAMPLES 16 and 17

In these examples, pivalic acid of formula $(CH_3)_3C—COOH$ was tested for octane performance by the same method as in the previous examples. Also tested was tert-butyl methyl ether, a commercial octane enhancer of formula $(CH_3)_3C—O—CH_3$ known as MTBE. The data are summarized in Table 3:

TABLE 3

| Example No. | Compound | Change in RON 1 Vol. % | Change in RON 5 Vol. % | Change in MON 1 Vol. % | Change in MON 5 Vol. % |
|---|---|---|---|---|---|
| 16 | Pivalic Acid | 0 | 1.2 | −0.2 | 0.8 |
| 17 | MTBE | 0 | 0.9 | −0.1 | 0.7 |

As shown in Table 3, a typical additive of the invention is superior to present, commercial oxygenated compounds for octane improvement. Also, if the data in Example 17 are compared against those of Examples 1, 9, 11, 13, and 15, it will be seen that pivalic anhydride, pivalonitrile, and pinacolone also prove superior to the commercial additive MTBE.

EXAMPLES 18 and 19

In these examples, t-butyl trimethyl silyl acetate is compared against t-butyl acetate for octane enhancement by the method of the previous examples. (t-Butyl acetate differs from t-butyl trimethyl silyl acetate by the replacement of a hydrogen atom in the methyl group of the acetate for a trimethyl silyl group.) A summary of the data obtained are shown in Table 4:

TABLE 4

| Example No. | Compound | Change in RON 1 Vol. % | Change in RON 5 Vol. % | Change in MON 1 Vol. % | Change in MON 5 Vol. % |
|---|---|---|---|---|---|
| 18 | t-butyl acetate | — | 0.6 | — | 0.2 |
| 19 | t-butyl trimethyl silyl acetate | 0.4 | 1.1 | 0.3 | — |

The data in Table 4 clearly reveal that t-butyl trimethyl silyl acetate substantially increases the octane value of gasoline. The data for this compound also prove superior to MTBE, the commercial additive tested in Example 17.

While the preferred embodiments have been described and illustrated, various modifications and substitutions may be made thereto without departing from the spirit and the scope of the present invention. The invention has been described by way of illustration and not limitation, and thus no limitation should be imposed other than those as indicated in the following claims.

We claim:

1. A composition comprising a base fuel comprising gasoline and an octane-enhancing proportion of a compound of chemical formula:

$$R1-\overset{\overset{Y}{\|}}{X}-R2 \quad \text{or} \quad R1-X\equiv Y \quad \text{or} \quad R1-N=Z \quad \text{or} \quad R1-A$$

(I) (II) (III) (IV)

wherein X=Y is C=O, C=N—R3, C=C=W,

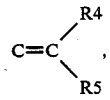

or C=S; X≡Y is C≡N or C≡C—R8; N=Z is N=O, N=C=W, or

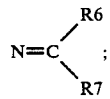

W is oxygen or sulfur; and A is an aryl-containing group with R1 bonded to the carbon atom of an aromatic ring, provided that A is not phenyl; R1 is either a substituted or unsubstituted trimethyl silyl group, or an organic radical containing a substituted or unsubstituted trimethyl silyl group; and R2, R3, R4, R5, R6, R7, and R8 are the same or different organic or inorganic species, provided that R4 is not hydrogen or a methyl group.

2. The composition of claim 1 wherein said compound is gasoline-soluble.

3. The composition of claim 1 wherein R2, R3, R4, R5, R6, R7, and R8 are selected from the group consisting of hydrogen and organic radicals having 1 to about 25 carbon atoms, provided that R4 is not hydrogen or methyl.

4. The composition of claim 1 wherein the compound corresponds to formula (I), (II) or (III) and X=Y is selected from the group consisting of C=O, C=N—R3, and C=S.

5. The composition of claim 1 wherein the compound corresponds to formula (I) or (II) where X=Y is C=O and X≡Y is C≡N.

6. The composition of claim 5 wherein R2 is selected from the group consisting of substituted and unsubstituted alkyl, carbyloxy, hydroxy, amino, acetyl, and acetyl-containing species of formula:

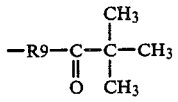

where R9 is an alkyl group of 1 to 5 carbon atoms.

7. The composition of claim 1 wherein R1 is an organic radical containing a trimethyl silyl group of formula:

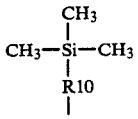

wherein R10 is an organic radical of 1 to 15 carbon atoms.

8. The composition of claim 5 wherein R1 is an organic radical containing a trimethyl silyl group of formula:

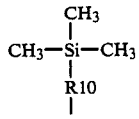

wherein R10 is a straight or branched chain alkyl group of 1 to 15 carbon atoms.

9. The composition of claim 8 wherein the compound corresponds to formula (I).

10. The composition of claim 9 wherein R2 is an alkoxy group.

11. The composition of claim 10 wherein R10 is an alkyl group of 1 to 3 carbon atoms.

12. The composition of claim 9 wherein R10 is an alkyl group of 1 to 3 carbon atoms.

13. The composition of claim 1 wherein the compound corresponds to formula (III) where N=Z is N=C=O.

14. The composition of claim 1 wherein said base fuel is gasoline.

15. The composition of claim 5 wherein said base fuel is unleaded gasoline.

16. The composition of claim 11 wherein said base fuel is unleaded gasoline.

17. The composition of claim 1 wherein said compound is present in a proportion of at least 2 volume percent.

18. The composition of claim 1 wherein R4 is neither hydrogen nor an alkyl group.

19. The composition of claim 9 wherein said base fuel is unleaded gasoline.

20. A fuel composition comprising a base fuel comprising gasoline and an additive for improving the octane of said base fuel, the additive comprising a compound containing a nitrogen or carbon atom double bonded or triple bonded to yet another atom, with said nitrogen or carbon atom being further bonded to an organic radical containing a substituted or unsubstituted trimethyl silyl group.

21. The composition of claim 20 wherein said compound comprises an organic radical containing a trimethyl silyl group of formula:

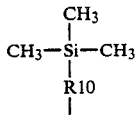

wherein R10 is a straight or branched chain alkyl group of 1 to 10 carbon atoms.

22. The composition of claim 21 wherein said base fuel is unleaded gasoline.

23. The composition of claim 22 wherein R10 is a methylene or dimethylene group.

24. The composition of claim 21 wherein R10 is a methylene group.

25. The composition of claim 20 wherein the compound comprises an unsubstituted trimethyl silyl group.

26. A fuel composition comprising unleaded gasoline and t-butyl trimethyl silyl acetate.

27. In a method for operating a spark ignition internal combustion engine, the improvement comprising using as a fuel in said engine the fuel composition of claim 1.

28. In a method for operating a spark ignition internal combustion engine, the improvement comprising combusting as a fuel in said engine the fuel composition of claim 5.

29. In a method for operating an automotive spark ignition internal combustion engine, the improvement comprising combusting as a fuel in said engine the fuel composition of claim 8.

30. In a method for operating a spark ignition internal combustion engine, the improvement comprising using as a fuel in said engine the fuel composition of claim 15.

31. In a method for operating a spark ignition internal combustion engine, the improvement comprising combusting as a fuel in said engine the fuel composition of claim 16.

32. In a method for operating a spark ignition internal combustion engine, the improvement comprising using as a fuel in said engine the fuel composition of claim 20.

33. In a method for operating a spark ignition internal combustion engine, the improvement comprising combusting as a fuel in said engine the fuel composition of claim 23.

34. In a method for operating an automotive spark ignition internal combustion engine, the improvement comprising using as a fuel in said engine the fuel composition of claim 25.

35. A composition comprising a base fuel comprising gasoline and one or more octane-enhancing additives, said additives consisting essentially of one or more compounds of chemical formula:

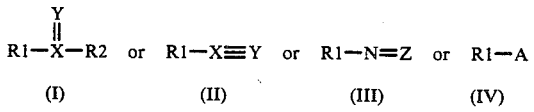

wherein X=Y is C=O, C=N—R3, C=C=W,

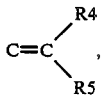

or C=S; X≡Y is C≡N or C≡C—R8; N=Z is N=O, N=C=W, or

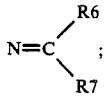

W is oxygen or sulfur; and A is an aryl-containing group with R1 bonded to the carbon atom of an aromatic ring, provided that A is not phenyl; R1 is or an organic radical containing a substituted unsubstituted trimethyl silyl group; and R2, R3, R4, R5, R6, R7, and R8 are the same or different organic or inorganic species, provided that R4 is not hydrogen or a methyl group.

36. The composition of claim 1 further containing less than 0.5 volume percent alcohol.

37. The composition of claim 1 further containing less than 0.1 volume percent alcohol.

38. The composition of claim 1 wherein said compound is t-butyl trimethyl silyl acetate.

39. The composition defined in claim 3 wherein said compound is gasoline-soluble and said base fuel is unleaded gasoline.

40. The composition defined in claim 4 wherein said compound is gasoline-soluble and said base fuel is unleaded gasoline.

41. The composition defined in claim 6 wherein said compound is gasoline-soluble and said base fuel is unleaded gasoline.

42. The composition defined in claim 7 wherein said compound is gasoline-soluble and said base fuel is unleaded gasoline.

43. The composition defined in claim 8 wherein said compound is gasoline-soluble and said base fuel is unleaded gasoline.

44. The composition defined in claim 10 wherein said compound is gasoline-soluble and said base fuel is unleaded gasoline.

45. The composition defined in claim 12 wherein said compound is gasoline-soluble and said base fuel is unleaded gasoline.

46. The composition defined in claim 20 wherein said compound is gasoline-soluble and said base fuel is unleaded gasoline.

47. The composition defined in claim 22 wherein said compound is gasoline-soluble and said base fuel is unleaded gasoline.

48. The composition defined in claim 23 wherein said compound is gasoline-soluble and said base fuel is unleaded gasoline.

49. The composition defined in claim 24 wherein said compound is gasoline-soluble and said base fuel is unleaded gasoline.

50. The composition defined in claim 25 wherein said compound is gasoline-soluble and said base fuel is unleaded gasoline.

51. The composition defined in claim 38 wherein said base fuel is unleaded gasoline.

52. The composition defined in claim 8 wherein X=Y is C=O.

53. The composition defined in claim 52 wherein said compound is gasoline-soluble and said base fuel is unleaded gasoline.

54. The composition of claim 1 wherein X=Y is C=O or C=N—R3, X≡Y is C≡N, and R2, R3, R4, R5, R6, R7, and R8 are selected from the group consisting of hydrogen and organic radicals having 1 to about 25 carbon atoms, provided that R4 is not hydrogen or methyl.

55. The composition as defined in claim 54 wherein the compound corresponds to formula (I) or (II).

56. The composition as defined in claim 55 wherein the compound corresponds to formula (I) and X=Y is C=O and R2 is an organic radical having 1 to 25 carbon atoms.

57. The composition of claim 6 wherein R3, R4, R5, R6, R7, and R8 are selected from the group consisting of hydrogen and organic radicals having 1 to about 25 carbon atoms, provided that R4 is not hydrogen or methyl.

58. The composition as defined in claim 57 wherein the compound corresponds to formula (I).

59. The composition of claim 8 wherein X=Y is C=O or C=N—R3, X≡Y is C≡N, and R2, R3, R4, R5, R6, R7, and R8 are selected from the group consisting of hydrogen and organic radicals having 1 to about 25 carbon atoms, provided that R4 is not hydrogen or methyl.

60. The composition as defined in claim 59 wherein the compound corresponds to formula (I) or (II).

61. The composition as defined in claim 59 wherein the compound corresponds to formula (I) and X=Y is C=O and R2 is an organic radical having 1 to 25 carbon atoms.

62. The composition of claim 6 wherein R1 is an organic radical containing a trimethyl silyl group of formula:

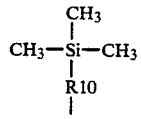

wherein R10 is an organic radical of 1 to 15 carbon atoms.

63. The composition defined in claim 54 wherein said compound is gasoline-soluble and said base fuel is unleaded gasoline.

64. The composition defined in claim 55 wherein said compound is gasoline-soluble and said base fuel is unleaded gasoline.

65. The composition defined in claim 56 wherein said compound is gasoline-soluble and said base fuel is unleaded gasoline.

66. The composition defined in claim 58 wherein said compound is gasoline-soluble and said base fuel is unleaded gasoline.

67. The composition defined in claim 59 wherein said compound is gasoline-soluble and said base fuel is unleaded gasoline.

68. The composition defined in claim 60 wherein said compound is gasoline-soluble and said base fuel is unleaded gasoline.

69. The composition defined in claim 61 wherein said compound is gasoline-soluble and said base fuel is unleaded gasoline.

70. The composition defined in claim 62 wherein said compound is gasoline-soluble and said base fuel is unleaded gasoline.

* * * * *

UNITED STATES PATENT AND TRADEMARK OFFICE

CERTIFICATE OF CORRECTION

PATENT NO. : 4,781,728

DATED : November 1, 1988

INVENTOR(S) : Peter J. Jessup, Stephen G. Brass, and Michael C. Croudace

It is certified that error appears in the above-identified patent and that said Letters Patent is hereby corrected as shown below:

In column 11, line 29, delete "or".

In column 11, line 30, after "substituted" insert --or--.

In column 12, line 37, change "8" to --7--.

Signed and Sealed this

Fourth Day of April, 1989

*Attest:*

DONALD J. QUIGG

*Attesting Officer*

*Commissioner of Patents and Trademarks*